US005105513A

United States Patent [19]

Marx et al.

[11] Patent Number: 5,105,513

[45] Date of Patent: Apr. 21, 1992

[54] WEAR DISKS FOR CRIMPING MACHINES

[75] Inventors: Günter Marx; Josef Bach; Jürgen Lorenz, all of Berlin, Fed. Rep. of Germany

[73] Assignee: Spinnstofffabrik Zehlendorf AG, Fed. Rep. of Germany

[21] Appl. No.: 546,242

[22] Filed: Jun. 29, 1990

[30] Foreign Application Priority Data

Jul. 1, 1989 [DE] Fed. Rep. of Germany ..... 3921708

[51] Int. Cl.[5] ..... D02G 1/12

[52] U.S. Cl. ..... 28/263

[58] Field of Search ..... 28/264, 269, 263; 19/66 C, 66.01; 75/236, 241

[56] References Cited

U.S. PATENT DOCUMENTS

| | | | |
|---|---|---|---|
| 2,311,174 | 2/1943 | Hitt | 19/66 |
| 3,237,270 | 3/1956 | Dennis | 28/264 |
| 3,600,776 | 8/1971 | Aoki et al. | 28/269 |
| 3,618,183 | 11/1971 | Funk et al. | 28/269 |
| 4,083,719 | 4/1978 | Arakawa et al. | 75/236 X |
| 4,115,908 | 9/1978 | Saxon et al. | 28/269 |
| 4,330,333 | 5/1982 | Gibbs | 75/236 X |
| 4,395,804 | 8/1983 | Saxon | 28/269 |
| 4,521,944 | 6/1985 | Stockbridge | 28/264 |
| 4,730,371 | 3/1988 | Broaddus | 28/269 |

FOREIGN PATENT DOCUMENTS

| | | | |
|---|---|---|---|
| 1435441 | 8/1964 | Fed. Rep. of Germany | 19/66 |
| 2113886 | 3/1971 | Fed. Rep. of Germany | 28/269 |
| 2604505 | 2/1976 | Fed. Rep. of Germany | 28/269 |
| 3503447 | 2/1985 | Fed. Rep. of Germany . | |

*Primary Examiner*—Werner H. Schroeder
*Assistant Examiner*—John J. Calvert
*Attorney, Agent, or Firm*—Connolly & Hutz

[57] ABSTRACT

A wear disk for a crimping machine used in the manufacture of synthetic fibers comprises a sinter material of metal and carbon having an apparent density of from 4 to 7 g/cm$^3$. The metal of the sinter material is particularly copper or an alloy thereof and therefore highly heat conductive.

6 Claims, No Drawings

WEAR DISKS FOR CRIMPING MACHINES

BACKGROUND OF THE INVENTION

The present invention relates to wear disks for crimping machines for manufacturing synthetic fibers.

Such wear disks, which are to prevent the sideways escape of the tow from the nip of the stuffer box, are known; their requirements have been discussed at great length for example in DE-A-2 113 886.

According to said reference, wear disks must be highly heat conductive, since in crimping, in particular dry crimping, the moving fiber bundles create friction which is converted into heat. To perform their function, wear disks must be in frictional contact with the end surfaces of the intake rolls, and the fiber plugs stuffed in the crimping box are moved along them under high pressure. In this process, the frictional area of the disks, i.e. a relatively small portion of their surfaces, additionally develops a great deal of heat. The material of the wear disks must therefore be highly heat conductive to ensure rapid dissipation of the heat generated and to prevent a fiber-damaging increase in the temperature of the friction surface. The high level of friction also leads to rapid wear of the disks, which is why it is an advantage to use a very abrasion-resistant material to make these parts. Abrasion-resistant, hard materials which have been proposed for the manufacture of wear disks are for example brass or ceramics (U.S. Pat. No. 4,395,804) or alumina mixed ceramics, e.g. (R) ALSIMAG (U.S. Pat. No. 2,311,174). The conventional materials which have this property, for example sinter ceramics formed from alumina or zirconia/silica, however, are not sufficiently heat conductive. A further disadvantage of these very hard materials is that any isolated instances of damage to the frictional surfaces of rotating disks are no longer repaired (worn away) in use and that the end surfaces of the intake rolls may be damaged.

Examples of softer materials recommended for wear disks are bronze, aluminum, nylon and PTFE (DE-A-3 503 447, DE-A-2 604 505, U.S. Pat. No. 3,237,270 and DE-A-1 435 441) and even graphite (DE-A-2 113 886). A problem with the current wear disks made of graphite is not only their high rate of wear but also their staining of the filaments, which is highly undesirable.

It is true that the widely used brass wear disks are highly heat conductive, but they still do not have a sufficiently long life or adequate self-repair properties. Plastics disks possess inadequate thermal conductivity.

SUMMARY OF THE INVENTION

It is an object of the present invention to manufacture wear disks of optimal abrasion resistance and high thermal conductivity which in addition have the advantage over conventional materials that they do not discolor the fiber bundles.

Wear disks must be manufactured to high precision and advantageously either consist of a relatively abrasion-resistant material or have been provided with a specific surface treatment in order that the tow or multifilament yarn may survive the crimping process with a minimum of fiber damage.

If the stress on the wear parts is not excessively high, it is frequently the case that surface treatment techniques, for example flame hardening, induction hardening and case hardening, already provide adequate wear protection.

However, a high surface hardness alone does not guarantee a high abrasion resistance, and, what is more, the layers formed by this process are very thin, so that they do not survive for a long period. In certain cases, even wear-resistant layers applied by the metal spraying technique have proved useful. An important prerequisite is firm adhesion to the basic material and inadequate toughness of the sprayed-on layer, which must not tend to deform or crumble off. Such surface treatments are difficult to carry out and raise the cost of friction disks considerably. In addition, it is not possible to remove the abrasion problems in full by this measure. Surface treatments are thus likewise not a satisfactory solution.

DETAILED DESCRIPTION OF THE INVENTION

By contrast, the above-described problems are substantially overcome by the wear disks according to the present invention. The wear disks according to the present invention are made of a sinter material which is formed from carbon and a metal or an alloy thereof and which combines optimal self-healing properties with a very high resistance to wear from friction stresses.

The friction materials required here convert kinetic energy into thermal energy. Such friction materials are these days also widely required in automotive construction and general mechanical engineering. They comprise multicomponent sinter materials, in some instances of an extremely complicated composition. Even sintered materials as used in the present invention are already known. They optionally contain for example from 5 to 70% of graphite, from 85 to 30% of copper and possibly up to 10%, preferably from 8 to 10% of tin, up to 15% of lead and up to 12% of zinc. In the formation according to the present invention, it is advantageous to have a high copper content within the range of between 70 and 90%, preferably above 80%. It is particularly preferred if the metal component consists of copper only. The high copper content makes it possible to increase the thermal conductivity a great deal; it should exceed 80 $W \times K^{1} \times m^{-1}$. It is preferably from 80 to 200, in particular 100–150 $W \times K^{-1} \times m^{-1}$. In some particularly highly suitable materials, the "metal coals" mentioned hereinafter by way of example, the thermal conductivity is $125 \pm 15$.

In principle, however, the copper can also be replaced by other metals in order that the properties of the sintered wear disks may be modified according to the desired use. For instance, it can be of advantage, for example, to replace the copper by iron, tin, zinc or lead or else only to combine it with these elements; but even the high-melting metals of subgroups 4, 5 and 6, combined with carbon into sinter materials, show advantageous ductile, wear-resistant properties.

The structure also has an effect on the properties of the sinter materials required, and it can be expressed for example in terms of the apparent density. Preference is given to sinter materials having an apparent density between 4 and 7 g $cm^3$, in particular between 5 and 6 g $cm^3$.

The apparent density is the ratio of the mass and the macroscopic volume of the material.

A particularly highly suitable material for the wear disks according to the present invention has surprisingly been found to be the so-called "metal coals", which are among the oldest sintered composites and which had hitherto been predominantly used as collector brushes for electrical motors.

Metal coals which are particularly highly suitable for use as the material for the wear disks according to the present invention comprise 80–85% of copper, 10–16% of lead and 5–9% of graphite. Very highly suitable commercial materials of this kind are for example the metal coal standard grades BDB and NL from W. L. Eichberg, Berlin.

The wear disk according to the present invention represents an optimal combination of wear resistance and self-healing properties, is highly heat conductive and surprisingly, unlike conventional materials, does not cause any staining of the yarns. This combination of positive properties leads to a long trouble-free running time of the crimping machines equipped therewith. Tows processed therewith are particularly uniform across the entire cross-section, whereas conventional processes frequently produce in practice a non-uniform sinusoidal or angular toothed shape of crimp. The uniform crimp arc guarantees good textile processing, including in particular on cutting and stretch-breaking tow converters.

What is claimed is:

1. A wear disk for crimping boxes, made of a sinter material formed from a metal and carbon, the metal of the sinter material being copper or an alloy thereof, and wherein the copper content of the sinter material is above 70%.

2. A wear disk for crimping boxes made of a sinter material formed from a metal and carbon, and wherein the apparent density of the sinter material is between 4 and 7 $g/cm^3$.

3. A wear disk for crimping boxes, made of a sinter material formed from a metal and carbon, and wherein the sinter material has a thermal conductivity of above 80 $W \times K^{-1} \times m^{-1}$ or above.

4. The wear disk for crimping boxes as claimed in claim 1, wherein the copper content of the sinter material is between 80 and 90%.

5. The wear disk for crimping boxes as claimed in claim 2, wherein the apparent density of the sinter material is between 5 and 6 $g/cm^3$.

6. The wear disk for crimping boxes as claimed in claim 3, having a thermal conductivity of 80–200 $W \times K^{-1} \times m^{-1}$.

* * * * *